US012600591B2

(12) United States Patent
Inoue et al.

(10) Patent No.: US 12,600,591 B2
(45) **Date of Patent: *Apr. 14, 2026**

(54) SHEET FEEDER AND IMAGE FORMING APPARATUS

(71) Applicants: Nobuo Inoue, Kanagawa (JP); Takeshi Iwasaki, Kanagawa (JP); Katsumi Okada, Kanagawa (JP); Kenta Takizawa, Kanagawa (JP)

(72) Inventors: Nobuo Inoue, Kanagawa (JP); Takeshi Iwasaki, Kanagawa (JP); Katsumi Okada, Kanagawa (JP); Kenta Takizawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 162 days.

This patent is subject to a terminal disclaimer.

(21) Appl. No.: 18/602,014

(22) Filed: Mar. 11, 2024

(65) Prior Publication Data

US 2024/0317526 A1 Sep. 26, 2024

(30) Foreign Application Priority Data

Mar. 20, 2023 (JP) ..... 2023-044091

(51) Int. Cl.
*B65H 19/10* (2006.01)
*B65H 26/06* (2006.01)

(52) U.S. Cl.
CPC ..... *B65H 19/105* (2013.01); *B65H 19/10* (2013.01); *B65H 26/063* (2013.01); *B65H 2301/41524* (2013.01); *B65H 2801/06* (2013.01)

(58) Field of Classification Search
CPC ..... B65H 19/105; B65H 2301/41524; B65H 19/10; B65H 26/063
See application file for complete search history.

(56) References Cited

U.S. PATENT DOCUMENTS

| | | | | |
|---|---|---|---|---|
| 11,273,654 | B2 * | 3/2022 | Eiyama | B41J 11/0095 |
| 12,264,024 | B2 * | 4/2025 | Okada | B65H 19/105 |
| 2021/0370693 | A1 | 12/2021 | Okada et al. | |
| 2021/0371227 | A1 | 12/2021 | Okada et al. | |

(Continued)

FOREIGN PATENT DOCUMENTS

| | | | |
|---|---|---|---|
| JP | 9-249341 | A | 9/1997 |
| JP | 2004-107080 | A | 4/2004 |

(Continued)

OTHER PUBLICATIONS

U.S. Appl. No. 18/478,803, filed Sep. 29, 2023.

*Primary Examiner* — Jeremy R Severson
(74) *Attorney, Agent, or Firm* — Duft & Bornsen, PC

(57) ABSTRACT

A sheet feeder includes a support to support a roll sheet winding a sheet, a sensor that is at a first position on the support and contacts a surface of the roll sheet to detect a level difference at a trailing edge of the roll sheet and output a first signal and a second signal, a roller that is at a second position different from the first position in a circumferential direction of the roll sheet on the support and contacts the surface of the roll sheet to guide the roll sheet, and circuitry to cause the roll sheet to rotate in a sheet feeding direction to feed the sheet, and detect the trailing edge of the roll sheet based on the first signal output from the sensor, and the second signal output from the sensor.

10 Claims, 14 Drawing Sheets

(56) References Cited

U.S. PATENT DOCUMENTS

| | | | |
|---|---|---|---|
| 2022/0363504 | A1 | 11/2022 | Okada |
| 2023/0264912 | A1 | 8/2023 | Okada |
| 2023/0271800 | A1 | 8/2023 | Okada et al. |

FOREIGN PATENT DOCUMENTS

| | | | |
|---|---|---|---|
| JP | 2013-230899 | A | 11/2013 |
| JP | 2020-158282 | A | 10/2020 |
| JP | 2021-187583 | A | 12/2021 |

* cited by examiner

| ROLL DIAMETER | INCLINATION: K1 | INCLINATION: K2 |
|---|---|---|
| SMALL (SHEET TUBE) | 3.5 | 5.5 |
| MEDIUM | 4 | 6 |
| LARGE | 5 | 7 |

SHEET FEEDER AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2023-044091, filed on Mar. 20, 2023, in the Japan Patent Office, the entire disclosure of which is incorporated by reference herein.

BACKGROUND

Technical Field

Embodiments of the present disclosure relate to a sheet feeder and an image forming apparatus.

Related Art

In a sheet feeder that feeds and conveys a roll sheet, a technology that detects the terminal edge of the roll sheet (roll end) is known (roll end detection technology). For example, in the related art, there is a configuration that detects the trailing edge of a roll sheet by bringing a roller into contact with the surface of the roll sheet and detecting rotational irregularities of the roller with a sensor, or by detecting changes in electric current of a motor that drives the roller in contact with the surface of the roll sheet. However, in the related art, since the trailing edge of the roll sheet is not directly detected in the configuration, erroneous detection may occur, and there is room to reduce or eliminate the erroneous detection.

SUMMARY

According to an embodiment of the present disclosure, a sheet feeder includes a support to support a roll sheet winding a sheet, a sensor that is at a first position on the support and contacts a surface of the roll sheet to detect a level difference at a trailing edge of the roll sheet and output a first signal and a second signal, a roller that is at a second position different from the first position in a circumferential direction of the roll sheet on the support and contacts the surface of the roll sheet to guide the roll sheet, and circuitry to cause the roll sheet to rotate in a sheet feeding direction to feed the sheet, and detect the trailing edge of the roll sheet based on the first signal output from the sensor in response to the trailing edge of the roll sheet passing over the sensor, and the second signal output from the sensor in response to the trailing edge of the roll sheet passing over the roller.

According to an embodiment of the present disclosure, an image forming apparatus includes the sheet feeder and an image forming device to form an image on the sheet fed by the sheet feeder.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
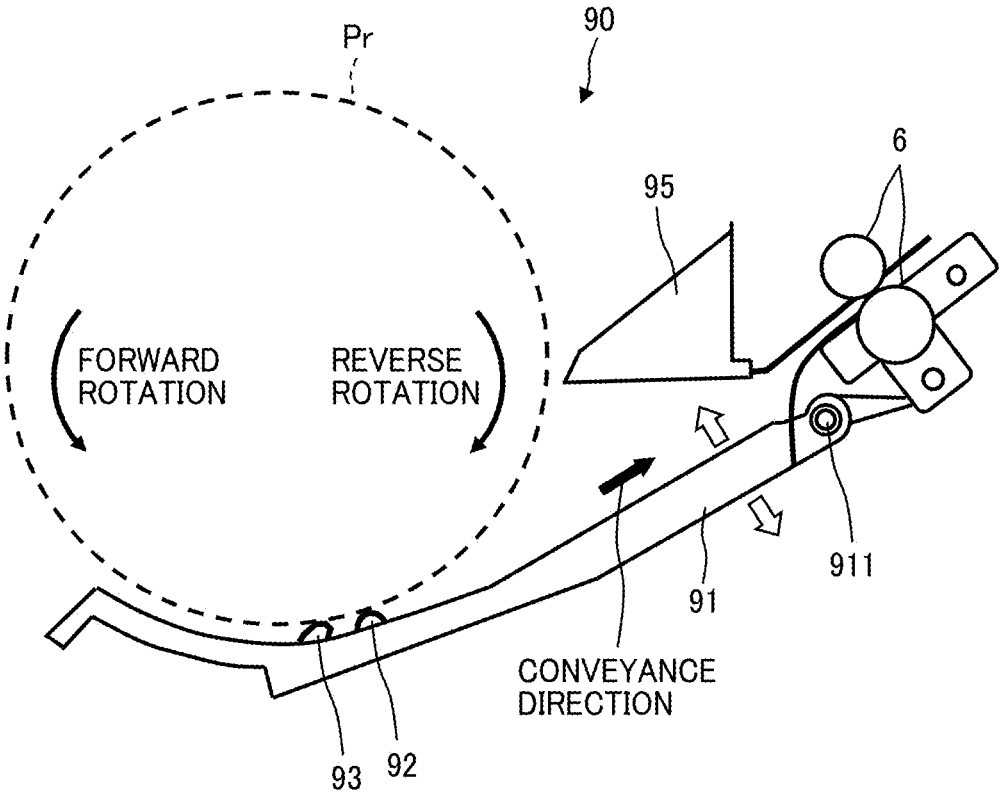
FIG. 1 is a side view of a main part of a configuration of a sheet feeder according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

According to an embodiment of the present disclosure, a sheet feeder that directly detects the trailing edge of a roll sheet can be provided.

A sheet feeder and an image forming apparatus according to embodiments of the present disclosure will be described below with reference to the drawings. The embodiments of the present disclosure are not limited to the configurations described below. Further, the embodiments of the present disclosure may be modified without departing from the scope or spirit of the disclosure and may be determined appropriately in accordance with applications. In the drawings, the same or like reference signs denote like elements having substantially the same or corresponding configurations, and descriptions thereof may be omitted.

In the sheet feeder according to an embodiment of the present disclosure, when the sheet feeder detects the trailing edge of a roll sheet (roll end detection), a sensor is brought into direct contact with the surface of the roll sheet, and the sensor detects a level difference corresponding to the thickness of the trailing edge of the roll sheet. In this way, the output of the sensor does not become unstable, and the roll end detection can reliably be detected.

In one aspect of the present disclosure, a sheet feeder feeds a sheet from a roll sheet formed by winding a long sheet and includes a sensor (e.g., a sensor 93) and a roller (e.g., a roller 92) disposed so as to face the center of the axis of the roll sheet, a support (e.g., an arm 91) that holds the sensor and roller so that the roller and the sensor are abutted against the surface of the roll sheet, and a controller that acquires a sensor signal detected by the sensor and controls the rotation of the roll sheet. The roller is disposed at a position different from the position of the sensor in a circumferential direction of the roll sheet, and the sensor has a detection accuracy that can detect a level difference of the trailing edge of the roll sheet. The controller rotates the roll sheet in a sheet feeding direction and detects a first signal detected by the sensor when the trailing edge of the roll sheet passes over the sensor and a second signal detected by the sensor when the trailing edge of the roll sheet passes over the roller. In the above description, the reference numerals are referred to as those in FIG. 11.

Further, the sheet feeder according to an embodiment of the present disclosure includes a detection mechanism that detects the leading edge of the roll sheet, and can automatically feed the sheet from the roll sheet. The sheet feeder detects the leading edge of the roll sheet by detecting a level difference at the leading edge of the sheet with a sensor, and conveys the sheet to a sheet conveyance unit. The sheet conveyance unit is a unit that supplies the sheet of the roll sheet to a supply destination, and is, for example, a conveyance roller pair 6 in FIG. 1 or a conveyance path 9 in FIG. 19 described below.

The sheet feeder will be described with reference to FIGS. 1 to 7, and the features of the sheet feeder will be described with reference to FIGS. 8 to 17. In addition, in terms of the recording medium, a sheet (paper) being conveyed is referred to as a sheet P, a roll state in which the sheet P is wound is referred to as a roll sheet Pr (or roll sheet Pa or Pb), and a roll sheet tube (also referred to as "core tube" or "core portion") of the roll sheet Pr is referred to as a sheet tube Ps.

FIG. 1 is a side view of a configuration of a main part of a sheet feeder according to an embodiment of the present disclosure. The sheet feeder 90 includes at least an arm 91, a roller 92, a sensor 93, and a conveyance roller pair 6 that serves as a conveyance unit. The sheet feeder 90 may further include an inlet guide plate 95. In FIG. 1, a broken line represents the position of the roll sheet Pr when the roll sheet Pr is set in the sheet feeder 90 by the user. The roll sheet Pr is held by a module component so as to be rotatable with respect to the roll sheet center (axis).

The arm 91 (guide plate) serving as a support for the roll sheet Pr is configured to be rotatable at a rotation center 911. The arm 91 is pressed toward the roll paper by a spring or the like at one side with respect to the rotation center 911. As a result, the arm 91 brings into contact with the outer diameter of the roll sheet even if the diameter of the roll sheet changes. The hollow arrows indicate the rotational directions of the arm 91. The arm 91 includes the roller 92 and the sensor 93 at another side with respect to the rotation center 911. Since the arm 91 is pressed toward the roll sheet, the arm 91 supports the roller 92 and the sensor 93 so that the roller 92 and the sensor 93 abut against the surface of the roll sheet Pr.

Figure 19:
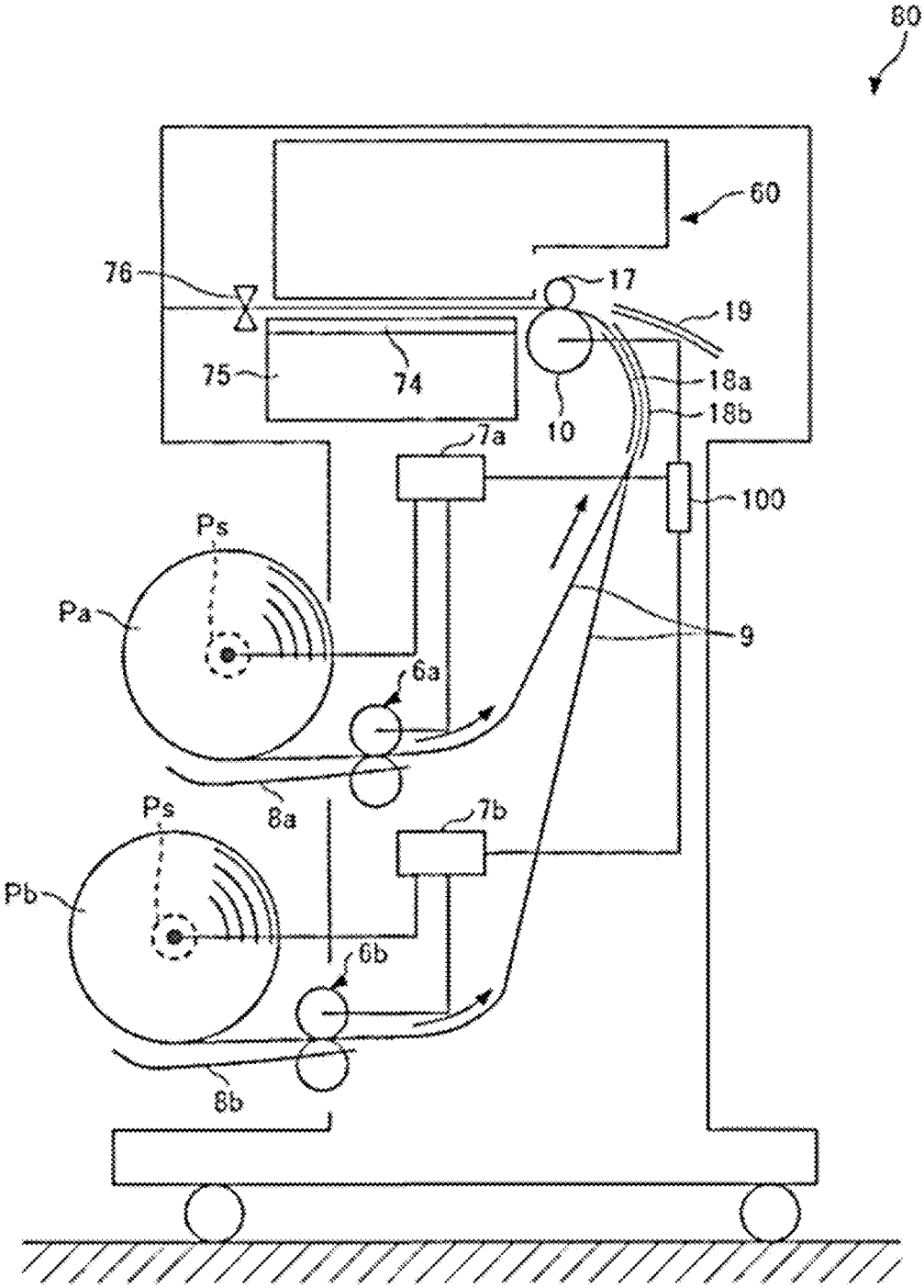
FIG. 19 is a side view of the image forming apparatus of FIG. 18.

The arm 91 serves as a guide plate that guides the conveyance direction of the sheet of the roll sheet Pr. The arm 91 may have a shape along the outer diameter of the roll sheet Pr (e.g., arc shape) at a portion (end portion) of which the roll sheet Pr is set so that the roll sheet Pr is held (so as not to be dropped) when the roll sheet Pr is set by the user. The arm 91 also functions as roll sheet receiving tables 8*a* and 8*b* as illustrated in FIG. 19. The arm 91 serving as the support also serves as a guide plate that guides the roll sheet. As a result, the number of parts can be reduced and the cost can be reduced.

The roller 92 and the sensor 93 are disposed so as to face substantially the center of the roll sheet (so as to face the center of the axis of the roll sheet) in spite of the diameter of the roll sheet. The roller 92 is disposed at a position different from the sensor 93 in the circumferential direction of the roll sheet Pr, and the roller 92 and the sensor 93 are disposed so as to be offset from each other in the circumferential direction. The sensor 93 has a detection accuracy that can detect a level difference (sheet thickness) at the leading or trailing edge of the roll sheet Pr.

The inlet guide plate 95 guides the sheet peeled from the roll sheet Pr in the sheet conveyance direction. For example, in the configuration in FIG. 1, during the sheet feeding operation (forward rotation of the roll sheet Pr), the arm 91 serving as a guide plate guides the sheet at the upstream in the sheet conveyance direction and the inlet guide plate 95 guides the sheet at the downstream in the sheet conveyance direction.

Figure 2:
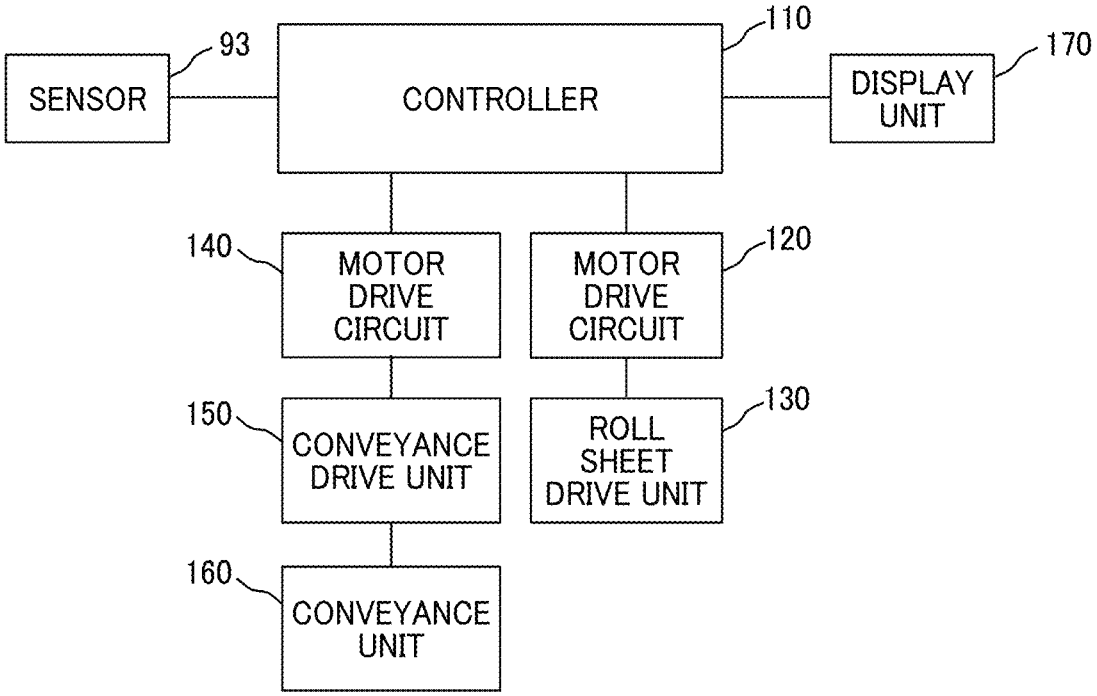
FIG. 2 is a block diagram illustrating functions of the sheet feeder in FIG. 1.

The function of the control of the sheet feeder will be described below. FIG. 2 is a functional block diagram illustrating a function of the sheet feeder according to an embodiment of the present disclosure. The controller 110 (i.e., circuitry) controls the overall sheet feeder. In the functional block diagram in FIG. 2, the controller 110 (i.e., circuitry) that controls the sensor 93 and motor drive circuits 120 and 140 is illustrated, and other functional blocks are omitted. The controller 110 (i.e., circuitry) acquires a signal (also referred to as a "sensor signal") detected by the sensor 93, and controls the rotation of the roll sheet. The controller 110 (i.e., circuitry) causes a display 170 to display information to be notified to the user. The function of the controller 110 (i.e., circuitry) may be executed by a controller 100 (see FIG. 19) that controls the overall image forming apparatus.

The controller 110 (i.e., circuitry) includes, for example, a central processing unit (CPU), a random-access memory (RAM), and a read-only memory (ROM). The CPU executes various programs and controls the overall image processing apparatus based on arithmetic processing and control programs. The RAM is a volatile storage medium for reading and writing information at high speed, and functions as a work area when the CPU executes the programs. The ROM is a read-only nonvolatile storage medium in which various programs and control programs are stored.

The motor drive circuit 120 drives a roll sheet drive unit 130 under the control of the controller 110 (i.e., circuitry). The roll sheet drive unit 130 rotates the roll sheet in the forward direction or the reverse direction. The roll sheet drive unit 130 uses, for example, a roll sheet rotation motor, and a driving gear. The motor drive circuit 140 drives the conveyance drive unit 150 under the control of the controller 110 (i.e., circuitry). The conveyance drive unit 150 includes, for example, a conveyance motor, or a drive gear, and drives the conveyance unit 160. The conveyance unit 160 is a conveyance device that conveys a sheet, and is, for example, the conveyance roller pair 6.

Figure 3:
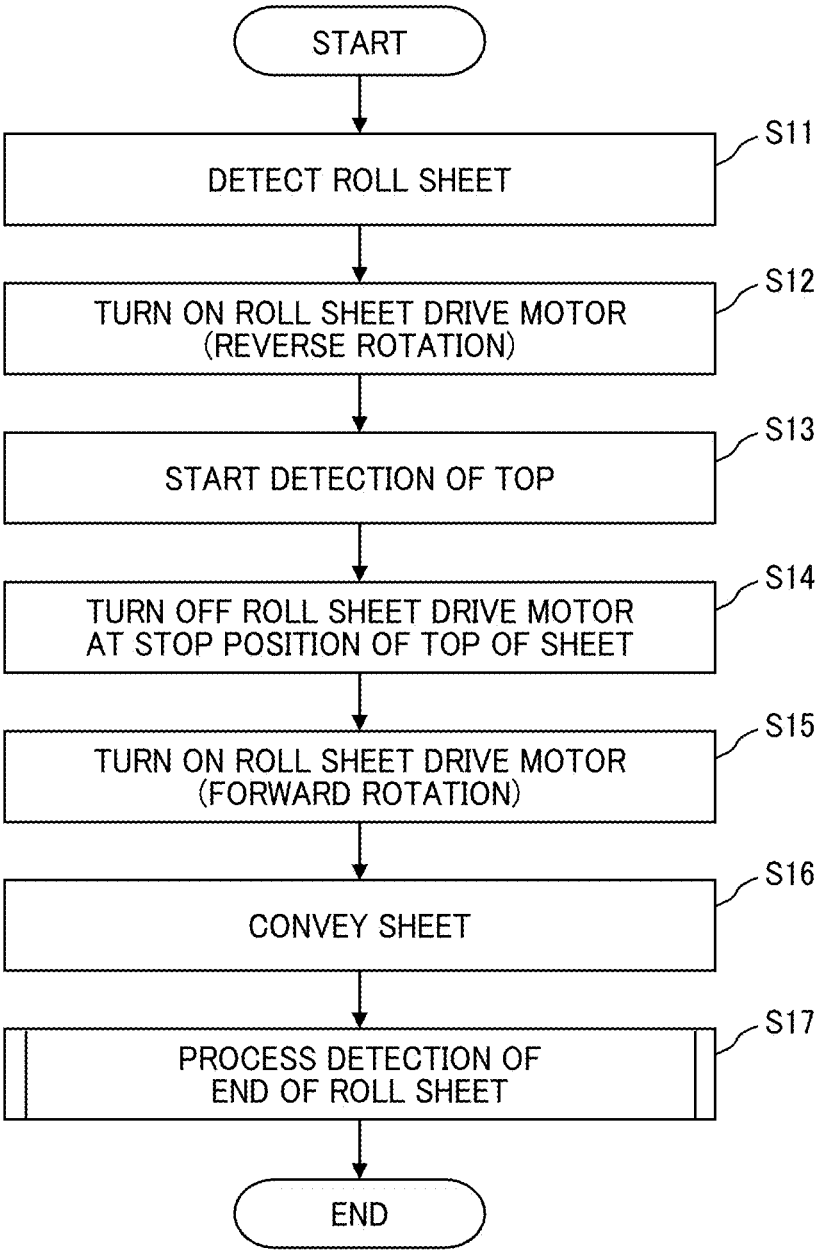
FIG. 3 is a flowchart of an operation of setting a roll sheet in the sheet feeder in FIG. 1.

An operation of setting the roll sheet Pr will be described below. FIG. 3 is a flowchart of an operation of setting a roll sheet in the sheet feeder according to an embodiment of the present disclosure. When the controller 110 (i.e., circuitry) detects that the roll sheet Pr is set in the sheet feeder (based on, e.g., the detection result of the sensor 93) (step S11), the controller 110 (i.e., circuitry) controls the motor drive circuit 120 to control the roll sheet drive unit 130 so as to reverse the roll sheet Pr. The roll sheet rotation motor (roll sheet drive unit 130) rotates the roll sheet Pr in a direction to wind the sheet by the reverse rotation (clockwise (CW) rotation) (step S12), and the sensor 93 executes an operation of detecting the leading edge of the sheet (step S13). When the sensor 93 detects the leading edge of the sheet, the motor drive circuit 120 stops the roll sheet rotation motor at the leading-edge stop position under the control of the controller 110 (i.e., circuitry) (step S14), and conveys the leading edge of the sheet in the conveyance direction by the forward rotation (counterclockwise (CCW) rotation) (step S15). The motor drive circuit 140 rotates the conveyance unit 160 to convey the leading edge of the sheet into the sheet feeder (step S16). After the leading edge of the sheet is set, the controller 110 (i.e., circuitry) starts the process that detects the trailing edge of the roll sheet (roll end detection process) (step S17). The detection operation of the trailing edge of the roll sheet will be described with reference to FIG. 14 below.

Figure 4A:
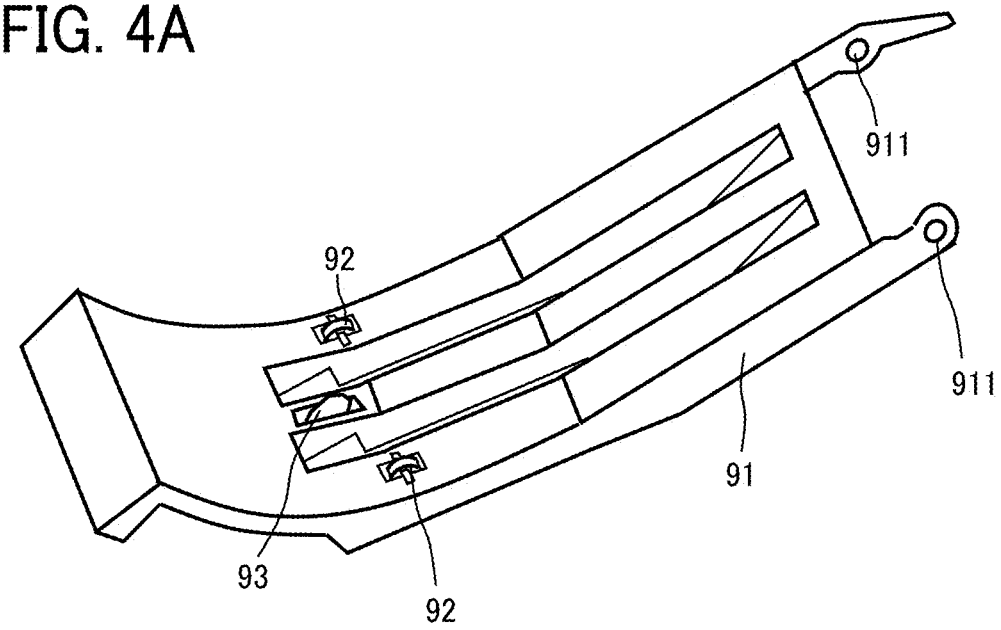
FIG. 4A is a perspective view of a configuration of an arm.
Figure 4B:
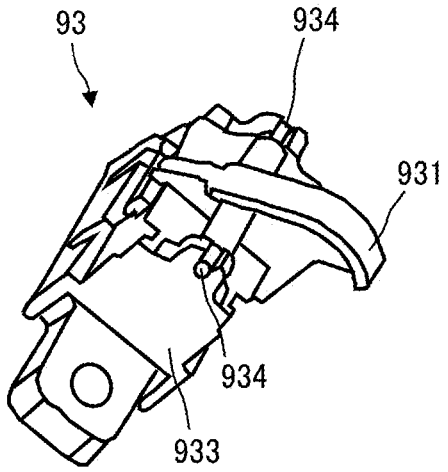
FIG. 4B is a schematic diagram illustrating an appearance of a sensor in FIG. 4A.
Figure 4C:
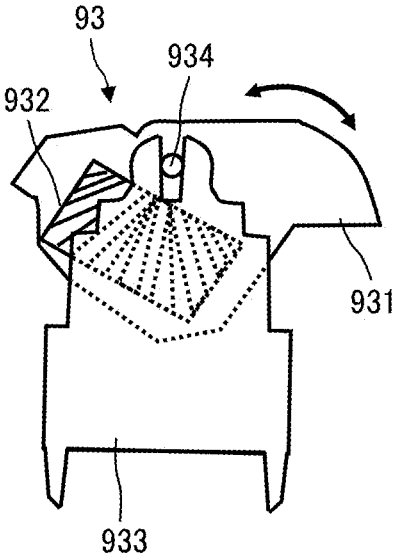
FIG. 4C is a side view of the sensor including an actuator and a side plate in FIG. 4B.

The structure of the arm serving as the support and the detection operation of the leading edge of the roll sheet will be described below. FIGS. 4A to 4C are diagrams illustrating a configuration of the arm according to an embodiment of the present disclosure. FIG. 4A is a perspective view of the arm 91. FIG. 4B is a schematic diagram of the appearance of the sensor 93 in FIG. 4A. FIG. 4C is a side view of an actuator including the sensor 93 and a side plate in FIG. 4B. In the operation (reverse rotation) in which the sensor 93 detects the leading edge of the roll sheet, the arm 91 is disposed so that the roller 92 of the arm 91 is disposed at the upstream in the rotation direction of the roll sheet Pr (the direction opposite to the direction in which the sheet is supplied) and the sensor 93 of the arm 91 is disposed at the downstream in the rotation direction of the roll sheet Pr.

The sensor 93 is, for example, an encoder sensor including an actuator 931 with a slit 932. The actuator 931 is disposed between two side plates 933 constituting a housing of the sensor 93, and the shaft 934 is fitted in bearings of the side plates 933, and the actuator 931 rotates around the shaft 934. The actuator 931 has, for example, an asymmetric shape about the shaft 934 as illustrated in FIG. 4C. The sensor 93 includes a light emitting element and a light receiving element, and detects the leading or trailing edge of the roll sheet Pr by counting the number of light passing through the slit 932 of the actuator 931 (by counting the number of signal waveforms) from the light emitting element to the light receiving element. The sensor 93 has a resolution of, for example, about five micrometers per pulse (μm/pulse), so that a level difference corresponding to the thickness of the sheet can be detected.

In the configuration illustrated in FIG. 4A, two rollers 92 are disposed, and the sensor 93 is disposed between the two rollers 92. Since the sensor 93 is disposed between the two rollers 92, the floating of the leading edge of the roll sheet can be reliably pressed, and the sensor output does not become unstable depending on the thickness, stiffness, and curl state of the sheet. As a result, the sensor 93 can reliably detect the leading edge of the roll sheet. Further, the two rollers 92 and the sensor 93 are disposed to be offset from each other in the circumferential direction. Accordingly, even if there is, for example, a partial flaw, the ratio of the flaw applied to both the two rollers 92 and the sensor 93 is reduced, and thus the erroneous detection is less likely to occur due to such a configuration. In the following description, the two or more rollers 92 are also referred to as roller portions.

Figure 5A:
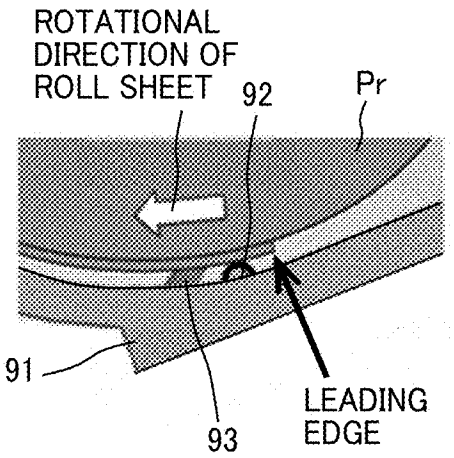
FIG. 5A is a diagram illustrating an operation of detecting a level difference on the surface of a roll sheet in a state before the leading edge of the roll sheet passes over a roller.
Figure 5B:
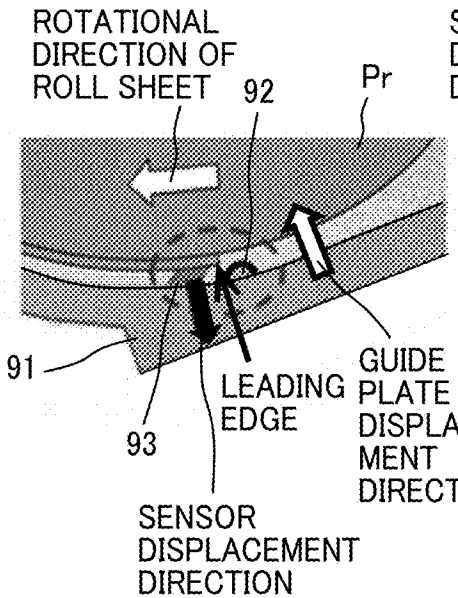
FIG. 5B is a diagram illustrating the operation of detecting the level difference on the surface of the roll sheet in a state after the leading edge of the roll sheet has passed over the roller and before the leading edge of the roll sheet passes over a sensor.
Figure 5C:
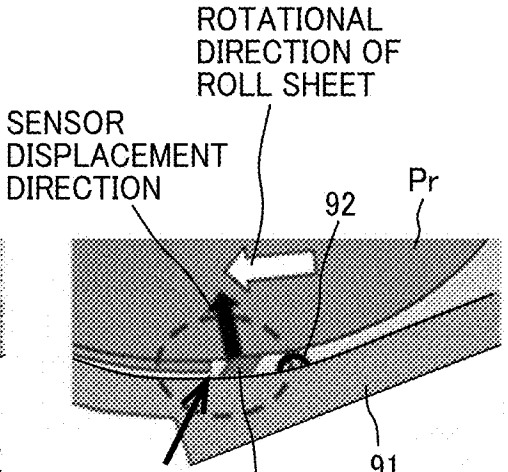
FIG. 5C is a diagram illustrating the operation that detects the level difference on the surface of the roll sheet in a state after the leading edge of the roll sheet has passed over the sensor.

FIGS. 5A to 5C are diagrams illustrating an operation of detecting a level difference (sheet thickness) on the surface of a roll sheet according to an embodiment of the present disclosure. In FIGS. 5A to 5C, the process in which the leading edge of the roll sheet Pr passes over the roller 92 and the sensor 93 is illustrated. FIG. 5A is a diagram illustrating a state before the leading edge of the roll sheet passes over the roller 92. FIG. 5B is a diagram illustrating a state after the leading edge of the roll sheet has passed over the roller 92 and before the leading edge of the roll sheet passes over the sensor 93. FIG. 5C is a diagram illustrating a state after the leading edge of the roll sheet has passed over the sensor 93.

The sensor 93 and the roller 92 are offset from each other in a near region (offset in the circumferential direction of the roll sheet). Since the roller 92 is disposed upstream from the sensor 93, the roller 92 can press the leading edge of the roll sheet until immediately before the leading edge of the sheet is detected by the sensor 93 (FIG. 5A). In this way, the sensor 93 can detect a level difference (sheet thickness) on the surface of the roll sheet Pr as the leading edge of the roll sheet Pr in a state where the leading edge of the roll sheet is in close contact with the surface of the roll sheet Pr. Accordingly, the output of the sensor 93 (detection result) is not unstable depending on the thickness, stiffness, and curl state of the sheet, and the sensor 93 can reliably detect the leading edge of the roll sheet Pr.

In an embodiment of the present disclosure, the roller 92 is disposed upstream from the sensor 93, but in the opposite configuration, the level difference can be detected. However, it is preferable to dispose the roller 92 upstream from the sensor 93 because the roller 92 can more reliably press the floating of the leading edge of the roll sheet until immediately before the detection. Further, as illustrated in FIG. 4, since the two rollers 92 are disposed and the sensor 93 is disposed between the two rollers 92, the floating of the leading edge of the roll sheet can be more reliably pressed down than the case where one roller 92 presses the leading edge of the roll sheet.

Figure 6:
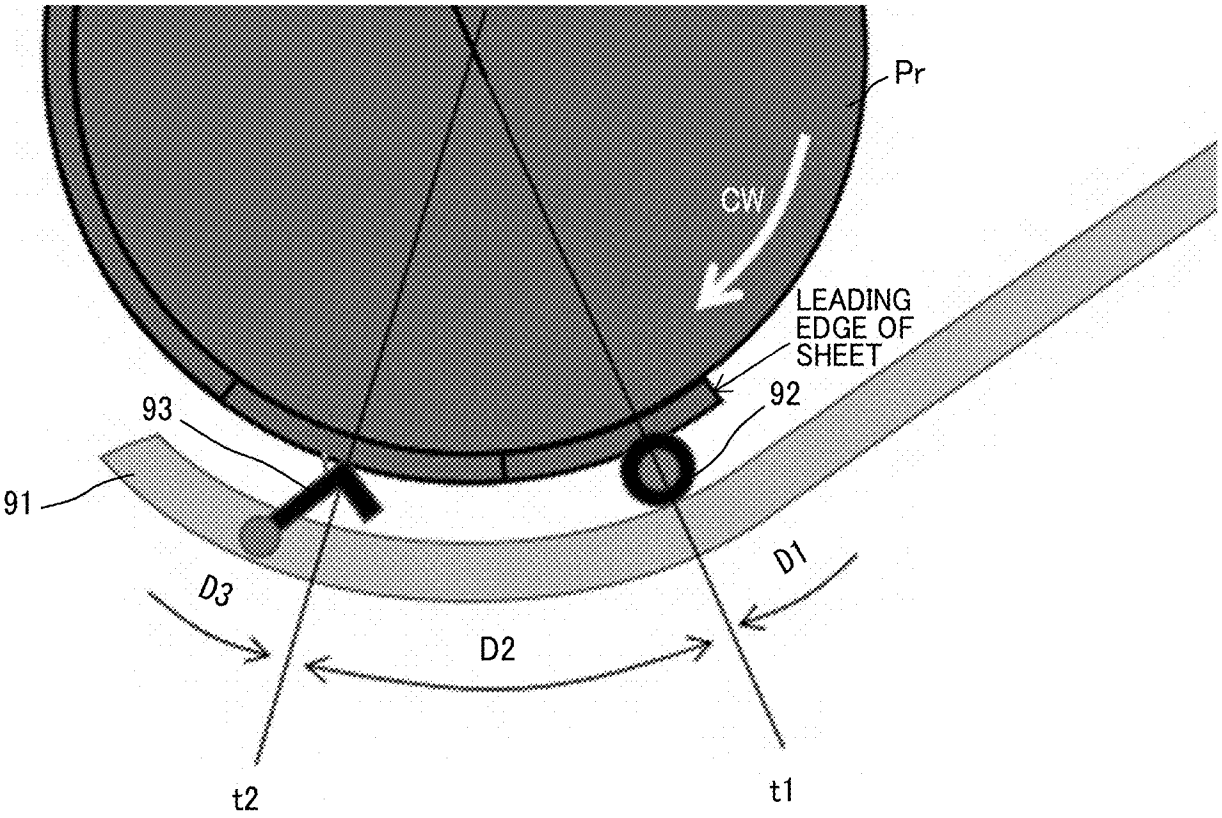
FIG. 6 is a diagram illustrating a positional relation between a roller, a sensor, and the leading edge of a roll sheet.
Figure 7:
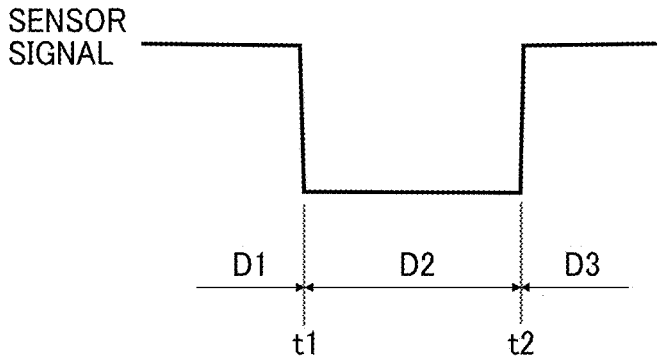
FIG. 7 is a diagram illustrating changes in a signal of the sensor in FIG. 6.

FIG. 6 is a diagram illustrating a positional relation between a roller, a sensor, and the leading edge of a roll sheet. FIG. 7 is a diagram illustrating changes in the sensor signal of FIG. 6. The controller 110 (i.e., circuitry) causes the motor drive circuit 120 that rotates the roll sheet Pr in the reverse direction (CW), and detects the leading edge of the roll sheet Pr based on a falling signal (third signal) of the sensor 93 at a time when the leading edge of the roll sheet Pr passes over the roller 92 (timing t1 in FIG. 7) and a rising signal (fourth signal) of the sensor 93 at a time when the leading edge of the roll sheet Pr passes over the sensor 93 (timing t2 in FIG. 7).

In an embodiment of the present disclosure, in the sheet feeder, the sensor outputs a third signal in response to a leading edge of the roll sheet passing over the roller and a fourth signal in response to the leading edge of the roll sheet passing over the sensor, and the circuitry further causes the roll sheet to rotate in an opposite direction opposite to the sheet feeding direction and detects a leading edge of the roll sheet based on the third signal and the fourth signal output from the sensor.

In the sheet feeder, the roller 92 and the sensor 93 are disposed in a circumferential direction such that the roller 92 and the sensor 93 are offset from each other. Even if there is a partial flaw, the ratio of the flaw applied to both the roller 92 and the sensor 93 is reduced. Accordingly, when there is a partial flaw, the signal waveform does not have a falling edge or a rising edge as illustrated in FIG. 7. Thus, in the configuration described above, the erroneous detection is less likely to occur. Further, since the reverse rotation continues after the leading edge of the roll sheet is detected, and the leading edge of the roll sheet stops at the sheet leading-edge stop position to shift to the forward rotation (CCW rotation), variations in an insertion orientation of the leading edge of the sheet into a guide inlet can be reduced and the sheet can be conveyed downstream in spite of the sheet conditions (curl, sheet type, and sheet thickness).

As described above, the level difference at the leading edge of the roll sheet corresponding to the sheet thickness can be directly detected with the configuration of the sheet feeder according to an embodiment of the present disclosure. As a result, the output of the sensor does not become unstable in spite of the thickness, stiffness, and curl state of the sheet, and the detection accuracy can be maintained. Since the setting operation of the roll sheet can be automatically completed only by placing the roll sheet, the manual operation can be eliminated, and in addition, skewed sheet and sheet jam due to guiding failure can be prevented.

Figure 8:
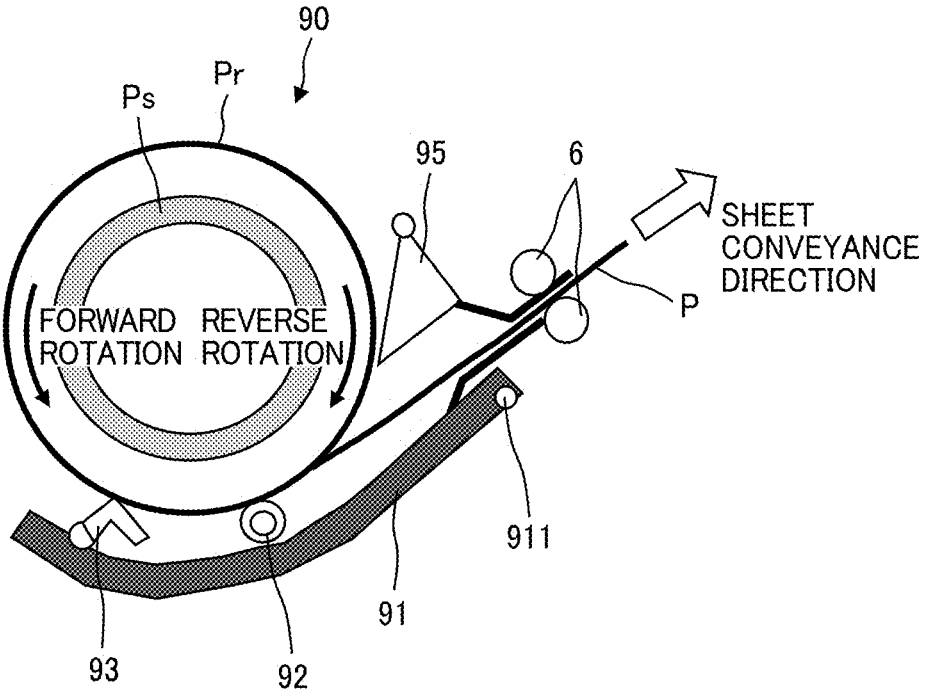
FIG. 8 is a schematic diagram illustrating automatic sheet feeding of a roll sheet.

Detection of the trailing edge of the roll sheet in the sheet feeder (roll end detection) will be described below. A state in which a roll sheet is fed and a state in which the roll sheet comes to the trailing edge of the sheet will be described below. FIG. 8 is a schematic diagram illustrating an operation of setting a roll sheet in the sheet feeder according to an embodiment of the present disclosure. As described above, the sensor 93 held by the arm 91 uses an encoder sensor including the actuator 931 with the slit 932 (see FIG. 4), and can detect a level difference corresponding to the thickness of the sheet by having a resolution of about five μm/pulse. After the leading edge of the roll sheet Pr is detected, the leading edge of the roll sheet is conveyed in the sheet conveyance direction, and the roll sheet Pr is fed automatically by the conveyance unit (conveyance roller pair 6) into the apparatus. In the sheet feeder, when the roll sheet Pr is exhausted (comes to the roll end) during conveyance, the following problems might occur.

Figure 9:
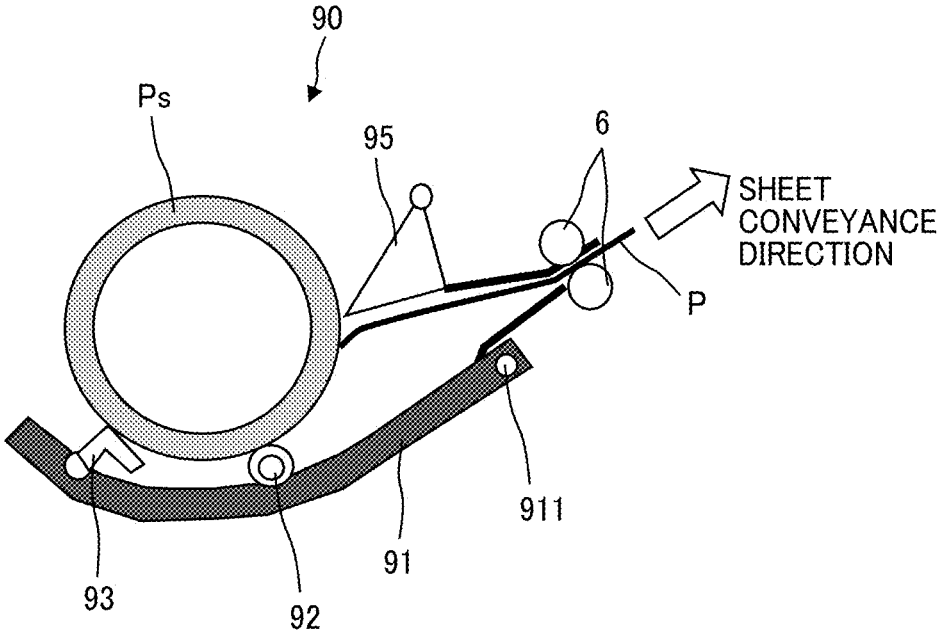
FIG. 9 is a schematic diagram illustrating a roll end state of a roll sheet whose trailing edge is glued.

FIG. 9 is a diagram illustrating a roll end state of the roll sheet Pr whose trailing edge is glued with glue. At the roll end, the sheet is stretched and the roll sheet Pr is conveyed until the state is determined to be a sheet stuck (paper jam). Thus, a large load is applied to the drive unit such as the roll sheet drive unit 130 or the conveyance drive unit 150, may cause problems such as breakage or generation of abnormal noise in some situations. At this time, a sheet stuck error is only displayed on the main body of the image forming apparatus including the sheet feeder, and it is not immediately recognized that the roll sheet Pr is exhausted.

Figure 10:
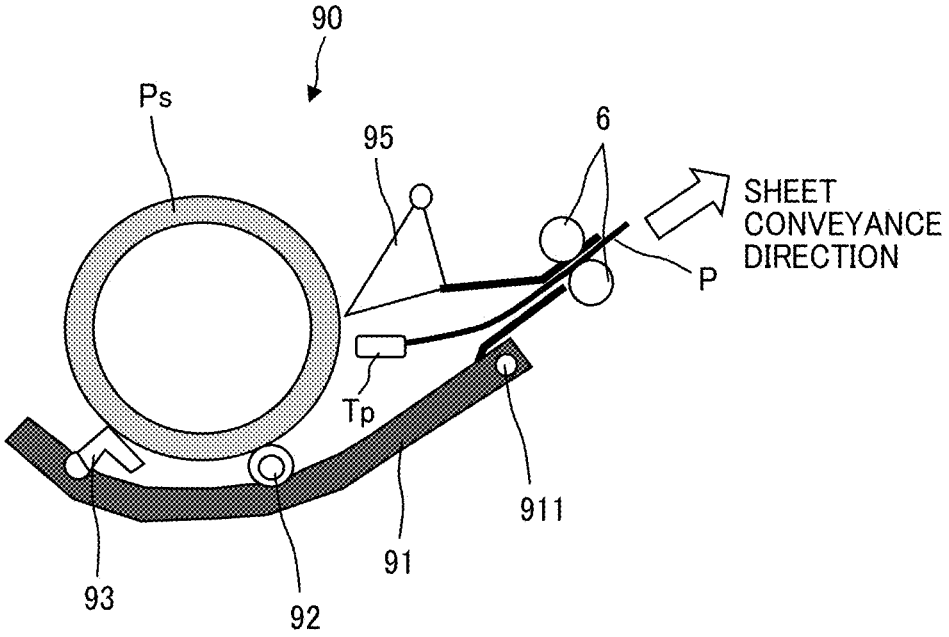
FIG. 10 is a schematic diagram illustrating a roll end state of a sheet whose trailing edge is attached with a tape.

FIG. 10 is a diagram illustrating a roll end state of the roll sheet Pr whose trailing edge is attached with a tape. At the roll end, unlike the state illustrated in FIG. 9, the trailing edge of the sheet is separated from the sheet tube Ps and the sheet is conveyed as it is. Since the trailing edge of the sheet is separated from the sheet tube Ps, the notification of the sheet stuck is not displayed at this time. However, if the tape Tp remains at the trailing edge of the sheet, the tape may stick to the inside of the sheet feeder, and cause the sheet stuck (paper jam).

Figure 11A:
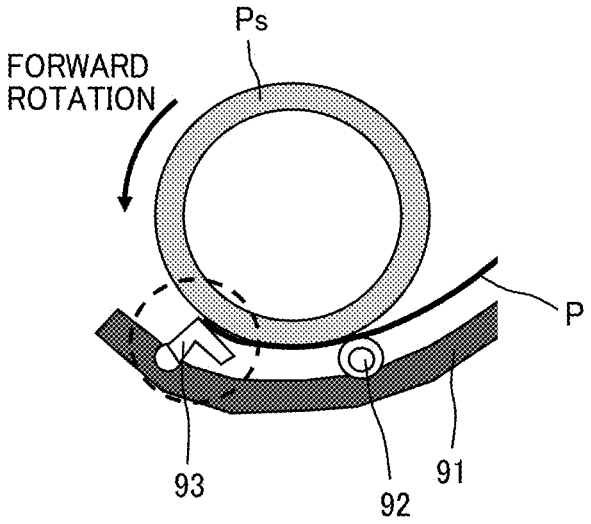
FIG. 11A is a schematic diagram illustrating an operation in which the sheet feeder detects the trailing edge of the roll sheet, according to an embodiment of the present disclosure.
Figure 11B:
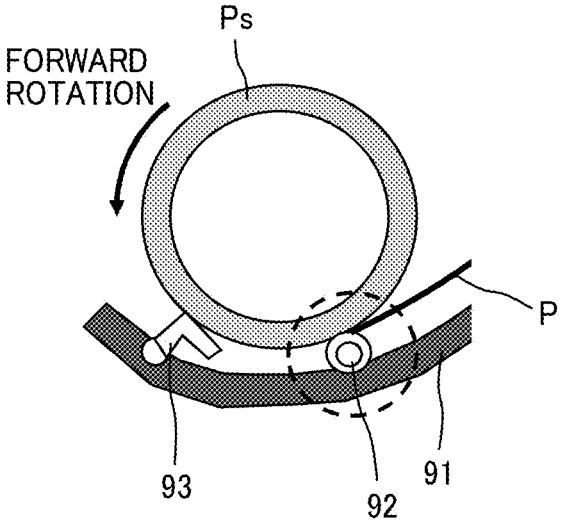
FIG. 11B is an enlarged diagram illustrating a state in which a sensor detects the trailing edge of the roll sheet.
Figure 11C:
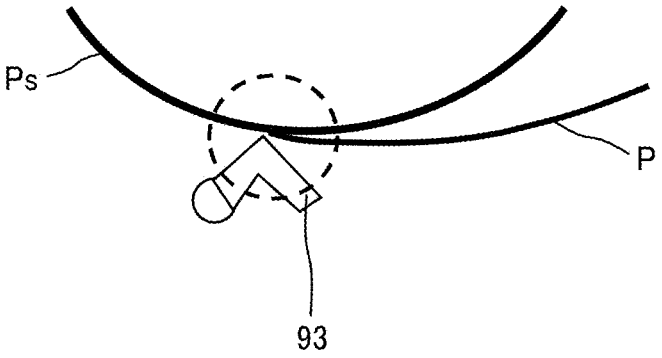
FIG. 11C is a schematic diagram illustrating a positional relation between a sheet tube, the roll sheet, and the sensor.

In order to solve these problems, the sheet feeder according to an embodiment of the present disclosure detects the unevenness of the surface of a roll sheet with the sensor 93 even during the forward rotation after detecting the leading edge of the roll sheet (after automatically feeding the roll sheet) as illustrated in FIG. 11. Thus, the sheet feeder reads, with the sensor 93, the level difference of the sheet P generated at the roll end to perform the roll end detection and detects the absence of the roll sheet Pr. In FIG. 11A, a state in which the sensor 93 detects the trailing edge of the sheet is illustrated at the right of the drawing, and a state in which the sheet P is conveyed after detecting the trailing edge of the sheet, and the trailing edge of the sheet P reaches the roller 92 is illustrated at the right side of the drawing. FIG. 11B is an enlarged diagram illustrating a state in which the sensor 93 detects the trailing edge of the sheet.

Figure 12A:
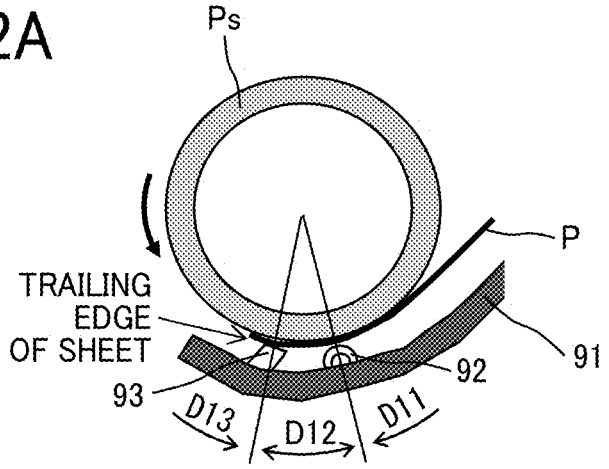
FIG. 12A is a diagram illustrating a positional relation between a roller, a sensor, and the trailing edge of the roll sheet in a state before the trailing edge of the roll sheet passes over the sensor.
Figure 12B:
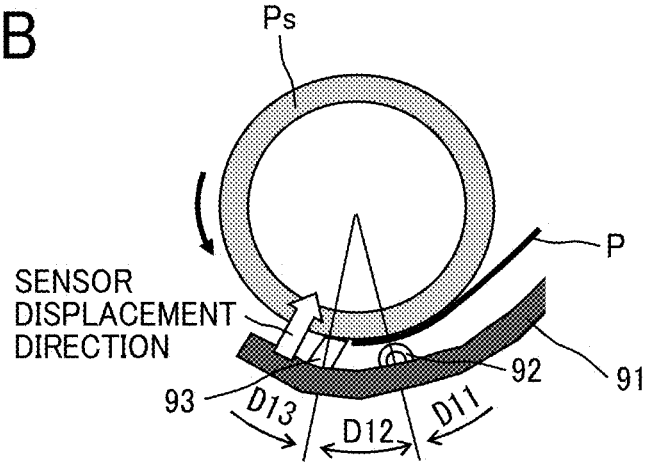
FIG. 12B is a diagram illustrating a positional relation between the roller, the sensor, and the trailing edge of the roll sheet in a state after the trailing edge of the sheet has passed over the sensor.
Figure 12C:
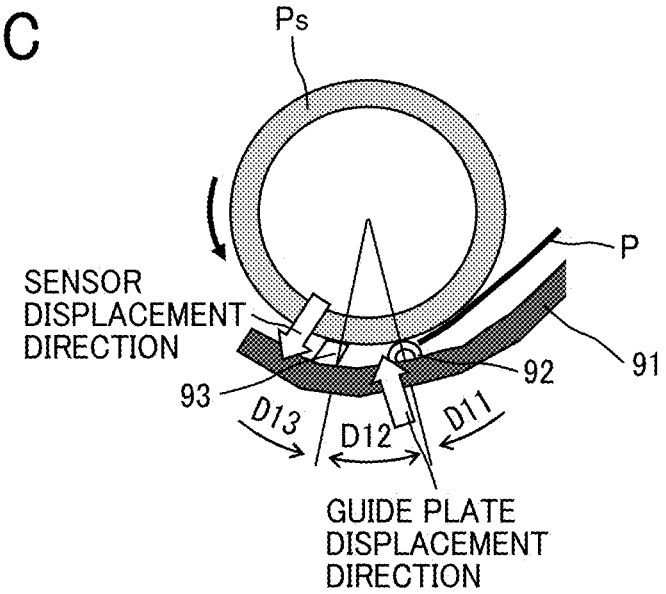
FIG. 12C is a diagram illustrating a positional relation between the roller, the sensor, and the trailing edge of the roll sheet in a state after the trailing edge of the sheet passed over the roller.
Figure 13:
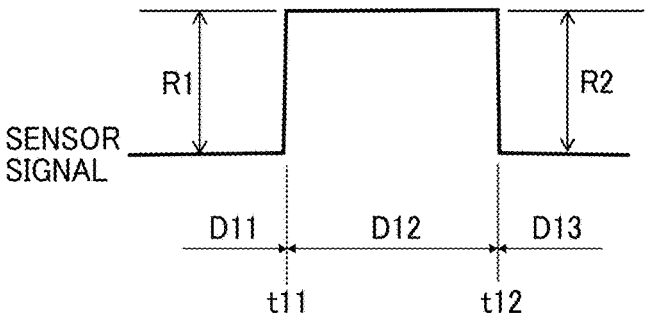
FIG. 13 is a diagram illustrating a change in a sensor signal detected in the state in FIG. 12.
Figure 14:
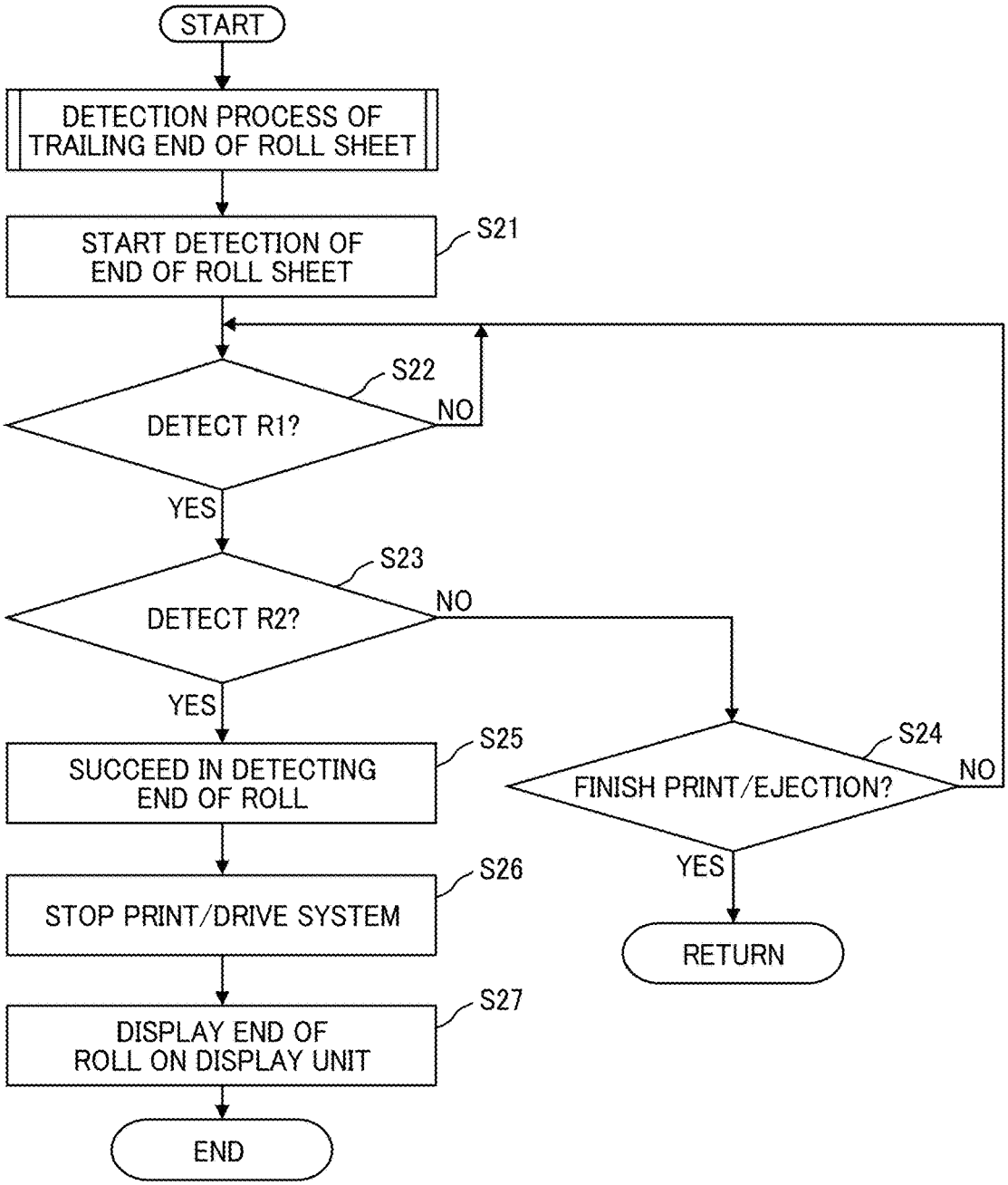
FIG. 14 is a flowchart of an operation of roll end detection.

The detection operation that performs roll end detection by detecting the level difference at the trailing edge of the roll sheet will be described in detail below. In FIGS. 12A and 12B, the positional relation among the rollers, the sensor, and the trailing edge of the roll sheet in the roll end detection is illustrated. FIG. 12A is a schematic diagram illustrating a state before the trailing edge of the roll sheet passes over the sensor 93. FIG. 12B is a schematic diagram illustrating a state at a time when the trailing edge of the roll sheet has passed over the sensor 93. FIG. 12C is a schematic diagram illustrating a state at a time when the trailing edge of the sheet has passed over the roller 92. In FIG. 13, the change in the sensor signal in the states of FIGS. 12A to 12C is illustrated. FIG. 14 is a flowchart of the operation of the roll end detection.

As described above, after the sheet conveyance operation (step S16 in FIG. 3), the process proceeds to the detection of the leading edge of the roll sheet (step S17 in FIG. 3). The sheet feeder detects the unevenness of the surface of the roll sheet by the sensor 93 while the roll sheet is rotating in the sheet conveyance direction (CCW) (the detection of the unevenness of the surface of the roll sheet is continued). When the trailing edge of the roll sheet passes over the sensor 93 (when the process proceeds to FIG. 12B from FIG. 12A), the actuator of the sensor 93 is moved upward, and when the trailing edge of the roll sheet passes over the rollers 92 (FIG. 12C), the arm 91 moves upward and the actuator of the sensor 93 moves downward, and the sensor signal changes as illustrated in FIG. 13. The change of the sensor signal illustrated in FIG. 13 has a phase opposite to a phase of the change of the sensor signal that detects the leading edge of the roll sheet as illustrated in FIG. 7. The signal R1 (first signal) is a sensor output (rising signal) when the trailing edge of the roll sheet passes over the sensor 93 (timing t11), and the signal R2 (second signal) is a sensor output (falling signal) when the trailing edge of the roll sheet passes over the rollers 92 (timing t12).

In an embodiment of the present disclosure, in the sheet feeder, the circuitry further detects the level difference at the trailing edge of the roll sheet based on a first inclination of a change in the first signal per unit time and a second inclination of a change in the second signal per unit time.

In an embodiment of the present disclosure, in the sheet feeder, the first signal is a rising signal, and the second signal is a falling signal.

An operation of the detection process of the trailing edge of the roll sheet will be described with reference to FIG. 14 below. When the detection operation of the trailing edge of the roll sheet starts (step S21), the controller 110 (i.e., circuitry) determines the trailing edge of the roll sheet while the roll sheet is rotating in the sheet conveyance direction (CCW) by using both sensor signals of the rising signal R1 (YES in step S22) when the trailing edge of the sheet passes over the sensor 93 and the falling signal R2 (YES in step S23) when the trailing edge of the sheet passes over the roller 92 (step S25). After the roll end detection, the controller 110 (i.e., circuitry) stops the conveyance of the sheet P and the related driving systems (e.g., the roll sheet drive unit 130 and the conveyance drive unit 150 in FIG. 2) (step S26), and displays that the roll sheet is exhausted on the display 170 (e.g., operation panel) (step S27).

On the other hand, when the sensor 93 does not detect the sensor signal R1 (NO in step S22), the controller 110 (i.e., circuitry) returns to step S22 and continues the process. Further, when the sensor 93 does not detect the sensor signal R1 (NO in step S22) and the printing or ejection is not finished (NO in step S24), the controller 110 (i.e., circuitry) returns to step S22 and continues the process. When the sensor 93 does not detect the sensor signal R2 (No in step S23) and the printing or ejection is finished (YES in step S24), the controller 110 (i.e., circuitry) returns to step S17 illustrated in FIG. 3.

In the operation in FIG. 14, as illustrated in FIG. 4, the roller 92 and the sensor 93 are disposed in the sheet feeder so as to be offset from each other in the circumferential direction. As a result, even if there is a partial flaw, the ratio of the flaw applied to both the roller 92 and the sensor 93 is reduced. Accordingly, when there is a partial flaw, the signal waveform does not have the rising and falling edges as illustrated in FIG. 13, and thus, erroneous detection is less likely to occur in the configuration.

In an embodiment of the present disclosure, a sheet feeder includes a support to support a roll sheet winding a sheet, a sensor that is at a first position on the support and contacts a surface of the roll sheet to detect a level difference at a trailing edge of the roll sheet and output a first signal and a second signal, a roller that is at a second position different from the first position in a circumferential direction of the roll sheet on the support and contacts the surface of the roll sheet to guide the roll sheet, and circuitry to cause the roll sheet to rotate in a sheet feeding direction to feed the sheet, and detect the trailing edge of the roll sheet based on the first signal output from the sensor in response to the trailing edge of the roll sheet passing over the sensor, and the second signal output from the sensor in response to the trailing edge of the roll sheet passing over the roller.

In the configuration of the sheet feeder according to an embodiment of the present disclosure, since the detection mechanism of the leading edge of the roll sheet for the automatic roll feeding is used together with the detection mechanism of the trailing edge of the roll sheet, no additional component is required for the detection mechanism of the trailing edge of the roll sheet. The sheet feeder detects a level difference corresponding to the sheet thickness at the trailing edge of the sheet of the roll sheet directly in the same manner as the detection of the leading edge of the roll sheet. In this way, since the trailing edge of the roll sheet can be directly detected, the output of the sensor does not become unstable, and the end of the roll sheet can be reliably detected. As a result, the accuracy of the roll end detection can be increased.

In an embodiment of the present disclosure, in the sheet feeder, the circuitry further causes the roll sheet to stop a rotation of the roll sheet after a detection of the trailing edge of the roll sheet by the sensor.

In an embodiment of the present disclosure, the sheet feeder, the circuitry further stops a rotation of the roll sheet after receiving the first signal and the second signal from the sensor.

Further, it is preferable that the controller stops the sheet feeding operation after the trailing edge of the roll sheet is detected. In this way, overload on the drive unit that conveys the roll sheet or generation of abnormal noise can be prevented. In addition, a sheet stuck caused by a tape for sticking the trailing edge of the roll sheet being mixed into the sheet conveyance unit can be prevented. The sheet feeder may further include a display that displays a sheet feeding state, and the controller may display that the roll sheet is exhausted on the display after the trailing edge of the roll sheet is detected. In this way, the user can be notified that the roll paper is exhausted. The display may be an operation panel included in image formation apparatus. In the sheet feeder, the controller detects the sensor signal at a time when the leading edge of the roll sheet passes over the roller while the roll sheet is rotated in a direction opposite to the feeding direction of the roll sheet and a sensor signal at a time when the leading edge of the roll sheet passes over the sensor, and the sheet feeding device detects the leading edge of the roll sheet. In this way, the leading edge of the roll sheet can be directly detected by using the configuration that detects the trailing edge of the roll sheet, and the leading edge of the roll sheet can be reliably detected without erroneous detection.

In an embodiment of the present disclosure, the sheet feeder further includes a display to display an empty state of the roll sheet after a detection of the trailing edge of the roll sheet by the sensor.

Figure 15:
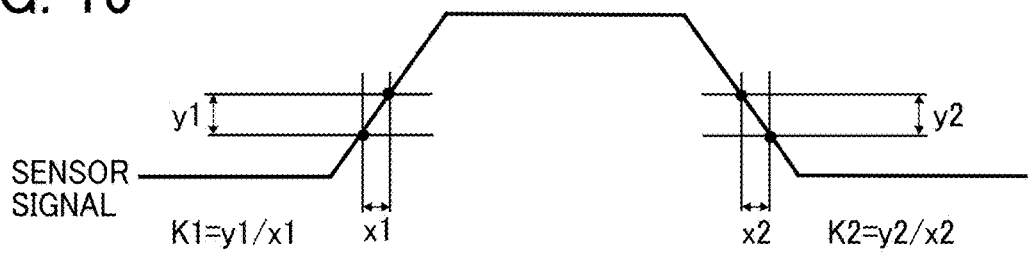
FIG. 15 is a diagram illustrating a waveform of the sensor signal in FIG. 13.

A modification of the roll end detection will be described below. Since the sensor 93 is brought into contact with the surface of the roll sheet while rotating and detects the surface unevenness of the roll sheet, the waveform of the sensor signal has inclinations K1 and K2 as illustrated in FIG. 15. The inclination K1 is an inclination of the signal variation per unit time of the sensor signal (R1) when the trailing edge of the sheet passes over the sensor 93 (the inclination of the first signal), and the inclination K2 is an inclination of the signal variation per unit time of the sensor signal (R2) when the trailing edge of the sheet passes over the roller 92 (the inclination of the second signal). The inclinations are calculated by the amount of change in the x-axis direction and the y-axis direction, and the inclination K1 can be calculated by the formula of K1=y1/x1, and the inclination K2 can be calculated by the formula of K2=y2/x2.

Figure 16:
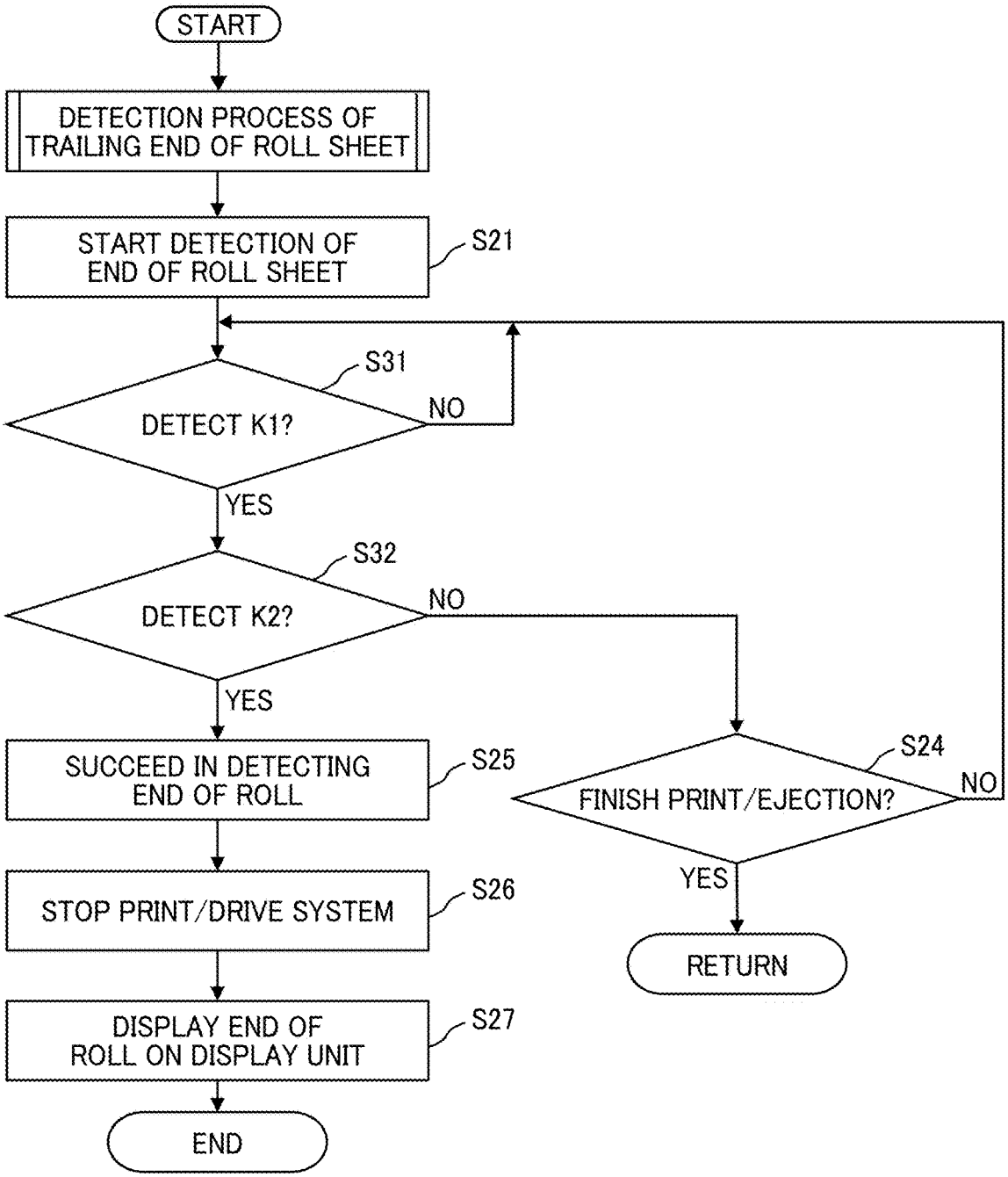
FIG. 16 is a flowchart of an operation of roll end detection based on inclinations of the sensor signal.
Figures 17, 18:
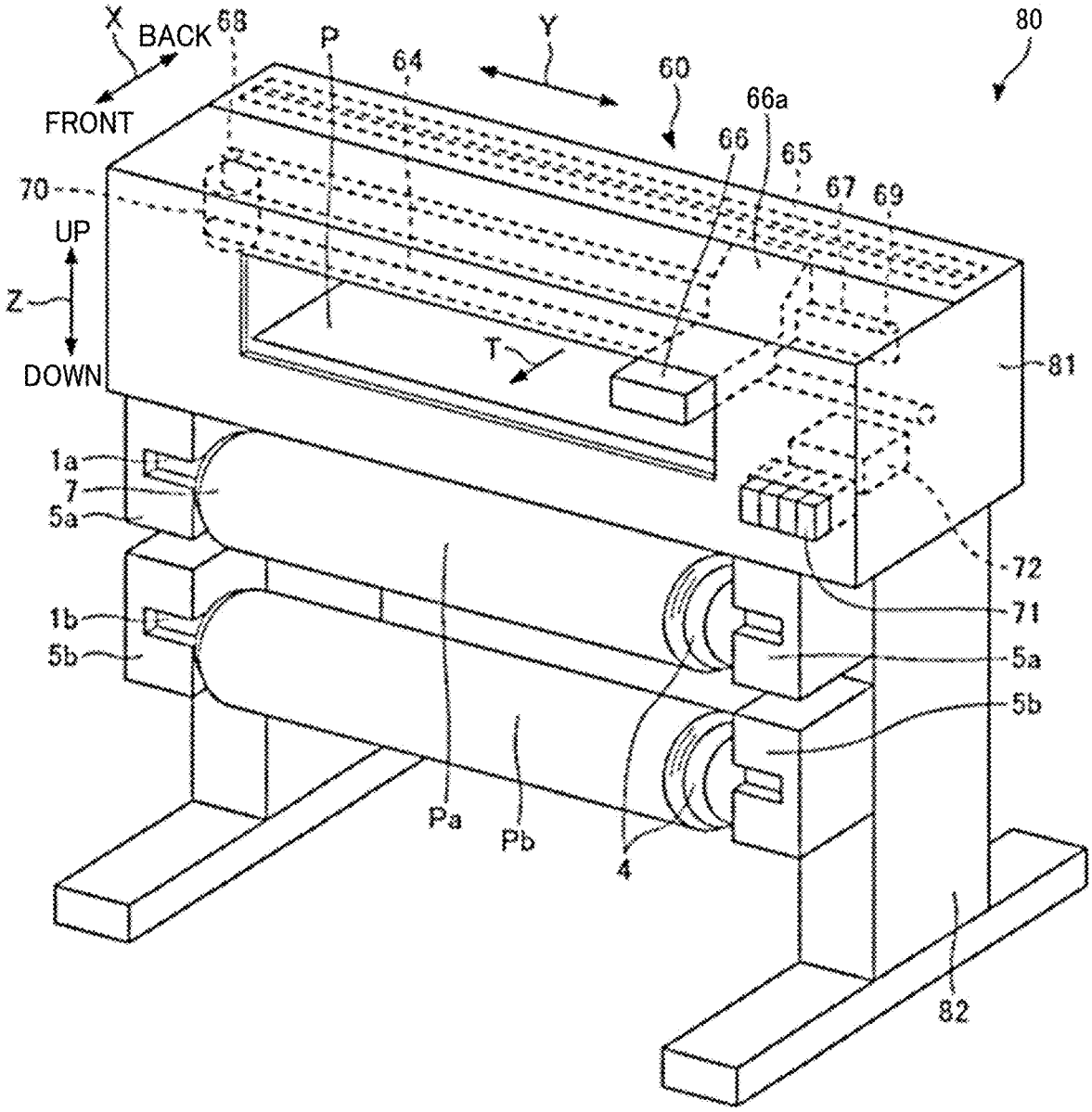
FIG. 17 is a diagram illustrating a relation between a roll diameter and inclinations of the sensor signal.
FIG. 18 is a perspective view of a schematic configuration of an image forming apparatus according to an embodiment of the present disclosure.

An operation of the detection process of the trailing edge of the roll sheet based on the inclination of the sensor signal will be described below with reference to FIG. 16. As described in steps S31 and S32 in FIG. 16, the detection of the roll sheet can be conducted using the inclinations K1 and K2 instead of the signals R1 and R2 in steps S22 and S23 in FIG. 14. The operation illustrated in FIG. 16 is the same as the operation illustrated in FIG. 14 except that steps S22 and S23 in FIG. 14 are replaced by steps S31 and S32. As illustrated in FIG. 17, in a relation between a roll diameter and the inclinations K1 and K2, the linear velocity on the surface of the roll sheet varies depending on the roll diameter. In other words, as the roll diameter decreases, the inclinations K1 and K2 decrease.

When the trailing edge of the roll sheet is detected by using the inclinations K1 and K2, the values of the inclinations K1 and K2 with a small roll diameter are set to be threshold values for reference. Accordingly, the erroneous detection due to the unevenness on the surface can be further reduced when the roll sheet still remains.

As described above, while the roll sheet is rotated in a sheet feeding direction in the sheet feeder, the controller detects the inclination of the change of the sensor signal per unit time at a time when the trailing edge of the roll sheet passes over the sensor and the inclination of the change of the sensor signal per unit time at a time when the trailing edge of the roll sheet passes over the roller. Thus, the trailing edge of the roll sheet (roll end) is detected. In this way, the erroneous roll end detection due to the unevenness on the surface can be prevented when the roll sheet remains. As a result, the trailing edge of the roll sheet can be reliably detected.

In an embodiment of the present disclosure, in the sheet feeder, the first inclination and the second inclination decrease with a decrease in a diameter of the roll sheet.

The image forming apparatus including the sheet feeder according to an embodiment of the present disclosure is described in detail with reference to the drawings below. An image forming apparatus according to an embodiment of the present disclosure includes an inkjet printer that prints on a recording medium by discharging ink droplets based on image data. In addition, an embodiment of the present disclosure can also be applied to an electrophotographic copying machine or printing machine that conveys a recording medium and prints.

FIG. 18 is a perspective view of a schematic configuration of the image forming apparatus according to an embodiment of the present disclosure, and FIG. 19 is a cross-sectional side view of the image forming apparatus in FIG. 18. The operation of the main parts will be described together with the overall configuration of the image forming apparatus according to an embodiment of the present disclosure below.

In FIG. 18, the two-headed arrow X represents a depth direction (front-rear direction) of an image forming apparatus 80, the two-headed arrow Y represents a width direction (main scanning direction) of the image forming apparatus 80, and the two-headed arrow Z represents an up-down direction of the image forming apparatus 80.

In FIG. 18, the image forming apparatus 80 is a serial liquid discharging type (ink discharging type) image forming apparatus, and a main body housing 81 is disposed on a main body frame 82. In the image forming apparatus 80, a main guide rod 64 and a sub-guide rod 65 are stretched in the main scanning direction indicated by the two-headed arrow Y in FIG. 18 in the main body housing 81. The main guide rod 64 movably supports the carriage 66, and the carriage 66 includes a connecting piece 66*a* that engages with the sub-guide rod 65 to stabilize the orientation of the carriage 66.

In the image forming apparatus 80, a timing belt 67 (endless timing belt) is disposed along the main guide rod 64, and the timing belt 67 is stretched between the driving pulley 68 and the driven pulley 69. The driving pulley 68 is rotated by the main scanning motor 70, and the driven pulley 69 is disposed in a state of giving a predetermined tension to the timing belt 67. The driving pulley 68 is driven to rotate by the main scanning motor 70, and rotates and moves the timing belt 67 in the main scanning direction based on the rotation direction of the driving pulley 68.

The carriage 66 is connected to a timing belt 67. Since the timing belt 67 is rotated in the main scanning direction by the driving pulley 68, the carriage 66 reciprocates in the main scanning direction along the main guide rod 64.

The image forming apparatus 80 includes a cartridge unit 71 and a maintenance unit 72 detachably accommodated in the main body housing 81 at the positions on one end in the main scanning direction. The cartridge unit 71 replaceably accommodates cartridges 73 that accommodate yellow (Y), magenta (M), cyan (C), and black (K) inks, respectively. Each cartridge of the cartridge unit 71 is connected to a recording head of a corresponding color among recording heads mounted on the carriage 66 by a pipe, and ink is supplied from the cartridge unit 71 to the recording head of each color through the pipe.

The image forming apparatus 80 records an image on the sheet P by discharging ink onto a sheet P intermittently conveyed in the sub-scanning direction (the direction of two-headed arrow X in FIG. 18) perpendicular to the main scanning direction on the platen 74 (plate) (see FIG. 19) while moving the carriage 66 in the main scanning direction. The material of the sheet P is not limited to paper, and various types of sheets such as a roll film can be used.

As illustrated in FIG. 19, in the image forming apparatus 80, the chamber 75 including the fun is disposed under the platen 74, and the fun is driven to convey the sheet P above the platen 74 while the sheet P is being brought into close contact with the platen 74.

The image forming apparatus 80 intermittently conveys the sheet P in the sub-scanning direction, and while the conveyance of the sheet P in the sub-scanning direction is stopped, the image forming apparatus 80 discharges ink from nozzle arrays of the recording heads mounted on the carriage 66 onto the sheet P on the platen 74 while moving the carriage 66 in the main scanning direction. Accordingly, an image is formed (recorded) on the roll-shaped sheet P having a roll-shape.

Since the maintenance unit 72 cleans and caps the discharge surface of the recording head and discharges unnecessary ink, the unnecessary ink is discharged from the recording head and the recording head is reliably maintained.

In the image forming apparatus 80, an encoder sheet is disposed in parallel with the timing belt 67 and the main guide rod 64 over at least a moving range of the carriage 66. An encoder sensor that reads the encoder sheet is attached to the carriage 66. The image forming apparatus 80 controls the movement of the carriage 66 in the main scanning direction by controlling the driving of the main scanning motor 70 based on the result of reading the encoder sheet by the encoder sensor.

Further, the reflective sensors (encoder sensors and sheet leading-edge detection sensors) mounted on the carriage 66 detect both ends of the sheet P conveyed to the image forming unit 60, and at that time, the size of the sheet P is detected from the positions in the main scanning direction read by the sheet leading-edge detection sensors.

In the image forming apparatus 80, as illustrated in FIGS. 18 and 19, two spool bearing bases 5*a* and 5*b* are disposed in the up-down direction Z in the main body frame 82 supporting the main body housing 81.

The sheet P (rolled sheet) drawn out from the leading edge of the roll sheet Pr set in the spool bearing bases 5*a* and 5*b* is conveyed in the conveyance path 9 by the conveyance roller pairs 6*a* and 6*b*, the registration roller 10, and the registration pressure roller 17 as indicated by arrows in FIG. 19. The controller 100 controls the driving device 7 to rotate the conveyance roller pairs 6*a* and 6*b*, the registration roller 10, and the registration pressure roller 17. The roll sheet receiving tables 8*a* and 8*b* are disposed under the roll sheets Pa and Pb to prevent the roll sheets Pa and Pb from falling.

The sheet P passes through the conveyance path 9 supported by the medium conveyance guide parts 18*a* and 18*b*, and is conveyed on the platen 74 in the image forming unit 60. When images are formed on both sides of the sheet, the reverse unit 19 reverses the sheet.

In the image forming unit 60, an image is formed by the liquid recording head discharging droplets of each color onto the sheet P based on the image data. A cutter 76 that extends in the sub-scanning direction (sheet width direction) and cuts the sheet P of the continuous sheet into a predetermined length is disposed at the sheet ejection unit in the forward conveyance direction of the sheet P on which the image is formed.

In order to align the leading edge of the sheet P of the continuous sheet conveyed, the cutter 76 is fixed to a wire or a timing belt stretched between multiple pulleys (one of which is connected to a driving motor), and moves in the main scanning direction (two-headed arrow Y) by the driving motor to cut the sheet P into a predetermined length. The sheet P cut by the cutter is ejected to the sheet ejection unit. In FIGS. 18 and 19, for example, the configurations of the image forming apparatus that can set the roll sheets Pa and Pb on the two spool bearing bases 5*a* and 5*b* are illustrated, but the image forming apparatus may include one spool bearing base. In the configuration of FIGS. 18 and 19, for example, the conveyance roller pair 6*a* or the conveyance roller pair 6*b* corresponds to the conveyance roller pair 6 illustrated in FIG. 1.

In an embodiment of the present disclosure, an image forming apparatus includes the sheet feeder and an image forming device to form an image on the sheet fed by the sheet feeder.

Aspects of the present disclosure are as follows, for example.

First Aspect

A sheet feeder includes: a support including a sensor and a roller that face a center of axis of a roll sheet in which a long sheet is wound, and supporting the sensor and the roller being abutted on a surface of the roll sheet; and a controller to acquire a signal to be detected by the sensor and control rotation of the roll sheet. The roller is disposed at a position different from a position of the sensor in a circumferential direction of the roll sheet. The sensor detects a level difference of a trailing edge of the roll sheet. The controller rotates the roll sheet in a sheet feeding direction to feed a sheet, and detects the trailing edge of the roll sheet based on a first signal detected by the sensor when the trailing edge of the roll sheet passes over the sensor and a second signal detected by the sensor when the trailing edge of the roll sheet passes over the roller.

Second Aspect

In the sheet feeder according to the first aspect, the controller stops rotation of the roll sheet after detection of the trailing edge of the roll sheet.

Third Aspect

The sheet feeder according to the first or second aspect further includes a display to display an exhausted state of the roll sheet after the controller detects the trailing edge of roll sheet.

Fourth Aspect

In the sheet feeder according to any one of the first to third aspects, the controller rotates the roll sheet in a direction opposite to the sheet feeding direction, and detects a leading edge of the roll sheet by using a third signal detected by the sensor when the leading edge of the roll sheet passes over the roller and a fourth signal detected by the sensor when the leading edge of the roll sheet passes over the sensor.

Fifth Aspect

In the sheet feeder according to any one of the first to fourth aspects, the controller detects the level difference of the trailing edge of the roll sheet based on an inclination of a signal change per unit time of the first signal and an inclination of a signal change per unit time of the second signal.

Sixth Aspect

An image forming apparatus includes the sheet feeder according to any one of the first to fifth aspects. Seventh Aspect In the sheet feeder according to the first aspect, the first signal is a rising signal and the second signal is a falling signal.

Eighth Aspect

In the sheet feeder according the first aspect, the controller stops rotation of the roll sheet after the sensor detects the first signal and the second signal.

Ninth Aspect

In the sheet feeder according to the fifth aspect, the inclination of the signal change per unit time of the first signal and the inclination of the signal change per unit time of the second signal decreases as a diameter of the roll sheet decreases.

Tenth Aspect

In the sheet feeder according to fourth aspect, a change of the first signal and a change of the third signal are in antiphase, and a change of the second signal and a change of the fourth signal are in antiphase.

Eleventh Aspect

A sheet feeder includes a support to support a roll sheet winding a sheet, a sensor that is at a first position on the support and contacts a surface of the roll sheet to detect a level difference at a trailing edge of the roll sheet and output a first signal and a second signal, a roller that is at a second position different from the first position in a circumferential direction of the roll sheet on the support and contacts the surface of the roll sheet to guide the roll sheet, and circuitry to cause the roll sheet to rotate in a sheet feeding direction to feed the sheet, and detect the trailing edge of the roll sheet based on the first signal output from the sensor in response to the trailing edge of the roll sheet passing over the sensor, and the second signal output from the sensor in response to the trailing edge of the roll sheet passing over the roller.

Twelfth Aspect

In the sheet feeder according to the eleventh aspect, the circuitry further causes the roll sheet to stop a rotation of the roll sheet after a detection of the trailing edge of the roll sheet by the sensor.

Thirteenth Aspect

The sheet feeder according to the eleventh or twelfth aspect further includes a display to display an empty state of the roll sheet after a detection of the trailing edge of roll sheet by the sensor.

Fourteenth Aspect

In the sheet feeder according to any one of the eleventh to thirteenth aspects, the sensor outputs a third signal in response to a leading edge of the roll sheet passing over the roller and a fourth signal in response to the leading edge of the roll sheet passing over the sensor, and the circuitry further causes the roll sheet to rotate in an opposite direction opposite to the sheet feeding direction and detects the leading edge of the roll sheet based on the third signal and the fourth signal output from the sensor.

Fifteenth Aspect

In the sheet feeder according to any one of the eleventh to fourteenth aspects, the circuitry further detects the level difference at the trailing edge of the roll sheet based on a first inclination of a change in the first signal per unit time and a second inclination of a change in the second signal per unit time.

Sixteenth Aspect

An image forming apparatus includes the sheet feeder and an image forming device to form an image on the sheet fed by the sheet feeder.

Seventeenth Aspect

In the sheet feeder according to the eleventh aspect, the first signal is a rising signal, and the second signal is a falling signal.

Eighteenth Aspect

In the sheet feeder according to the eleventh aspect, the circuitry further stops a rotation of the roll sheet after receiving the first signal and the second signal from the sensor.

Nineteenth Aspect

In the sheet feeder according to the fifteenth aspect, the first inclination and the second inclination decrease with a decrease in a diameter of the roll sheet.

Twentieth Aspect

In the sheet feeder according to the fourteenth aspect, the first signal changes in opposite phase of a change in the third signal, and the second signal changes in opposite phase of a change in the fourth signal.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above. Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

The invention claimed is:

1. A sheet feeder comprising:

a support to support a roll sheet winding a sheet;

a sensor at a first position on the support, the sensor contacting a surface of the roll sheet to detect a level difference at a trailing edge of the roll sheet and output a first signal and a second signal;

a roller at a second position different from the first position in a circumferential direction of the roll sheet on the support, the roller contacting the surface of the roll sheet to guide the roll sheet; and circuitry configured to:

cause the roll sheet to rotate in a sheet feeding direction to feed the sheet; and detect the trailing edge of the roll sheet based on:

the first signal output from the sensor in response to the trailing edge of the roll sheet passing over the sensor; and the second signal output from the sensor in response to the trailing edge of the roll sheet passing over the roller.

2. The sheet feeder according to claim 1, wherein the circuitry is further configured to cause the roll sheet to stop a rotation of the roll sheet after a detection of the trailing edge of the roll sheet by the sensor.

3. The sheet feeder according to claim 1, further comprising a display to display an empty state of the roll sheet after a detection of the trailing edge of the roll sheet by the sensor.

4. The sheet feeder according to claim 1, wherein the sensor outputs:

a third signal in response to a leading edge of the roll sheet passing over the roller; and a fourth signal in response to the leading edge of the roll sheet passing over the sensor, and the circuitry is further configured to:

cause the roll sheet to rotate in an opposite direction opposite to the sheet feeding direction; and detect the leading edge of the roll sheet based on the third signal and the fourth signal output from the sensor.

5. The sheet feeder according to claim 4, wherein the first signal changes in an opposite phase to a change in the third signal, and the second signal changes in an opposite phase to a change in the fourth signal.

6. The sheet feeder according to claim 1, wherein the circuitry is further configured to:

detect the level difference at the trailing edge of the roll sheet based on:

a first inclination of a change in the first signal per unit time; and a second inclination of a change in the second signal per unit time.

7. The sheet feeder according to claim 6, wherein the first inclination and the second inclination decrease with a decrease in a diameter of the roll sheet.

8. An image forming apparatus comprising:

the sheet feeder according to claim 1; and an image forming device to form an image on the sheet fed by the sheet feeder.

9. The sheet feeder according to claim 1, wherein the first signal is a rising signal, and the second signal is a falling signal.

10. The sheet feeder according to claim 1, wherein the circuitry is further configured to stop a rotation of the roll sheet after receiving the first signal and the second signal from the sensor.

* * * * *